United States Patent [19]

Guenther

[11] 4,193,586

[45] Mar. 18, 1980

[54] HAND RAIL

[75] Inventor: Torbett B. Guenther, Plymouth, Mich.

[73] Assignee: C. D. Sparling Company, Plymouth, Mich.

[21] Appl. No.: 855,882

[22] Filed: Nov. 30, 1977

Related U.S. Application Data

[63] Continuation-in-part of Ser. No. 654,183, Feb. 2, 1976.

[51] Int. Cl.[2] ..... E04F 11/18

[52] U.S. Cl. ..... 256/69

[58] Field of Search ..... 256/65, 59, 67, 69; 4/185 H; 16/111 R, 125; 248/251; 403/198, 230

[56] References Cited

U.S. PATENT DOCUMENTS

| | | | |
|---|---|---|---|
| 809,670 | 1/1906 | Covert | 248/251 X |
| 2,147,028 | 2/1939 | Gundelfinger | 16/125 |
| 2,815,972 | 12/1957 | Lagervall | 256/65 UX |
| 2,940,719 | 6/1960 | Taubman | 248/251 |
| 3,384,333 | 5/1968 | Bohlman et al. | 248/251 |

*Primary Examiner*—Andrew V. Kundrat

*Attorney, Agent, or Firm*—Barnes, Kisselle, Raisch & Choate

[57] ABSTRACT

A hand rail for use on a wall comprising a length of tubular material including a central portion and end portions extending from the bent portions at an obtuse angle and engaging the wall. The end portions have free ends defining a plane which is at an acute angle to the plane of the central portion and end portions. The ends of said end portions engaging the wall are fastened to the wall at the ends of the end portions.

32 Claims, 19 Drawing Figures

50
51
52
53
54
55
56
11

HAND RAIL

This application is a continuation-in-part of my copending application, Ser. No. 654,183, filed Feb. 2, 1976. This invention relates to hand rails.

BACKGROUND OF THE INVENTION

In private and public buildings, it is common to provide a hand rail extending along a wall to facilitate the movement of persons along the wall. Such hand rails are particularly helpful in areas where disabled or invalid persons are present. Conventionally such hand rails comprise a length of solid or tubular material maintained in spaced relation to the wall by laterally extending brackets or other devices. In the fastening to the wall, flanges are provided about the sections to provide a means for fastening the hand rails that will adequately support the loads thereon.

Such hand rails often protrude and result in an obstruction even though the ends may be curved to the extent of 90°.

Among the objects of the invention are to provide a hand rail which is simple, has minimal protrusions and obstructions, has generally unexposed fastening means and which provides adequate strength at minimum cost.

SUMMARY

In accordance with the invention, the hand rail comprises a length of tubular material including a central portion and end portions extending from the bent portion at an obtuse angle. The end portions having free ends defining a plane which is at an acute angle to the plane of the central portion and end portions. The ends of the end portions engage the wall, and means are provided for fastening the rail to the wall at the ends of the end portions.

DESCRIPTION

Figure 1:
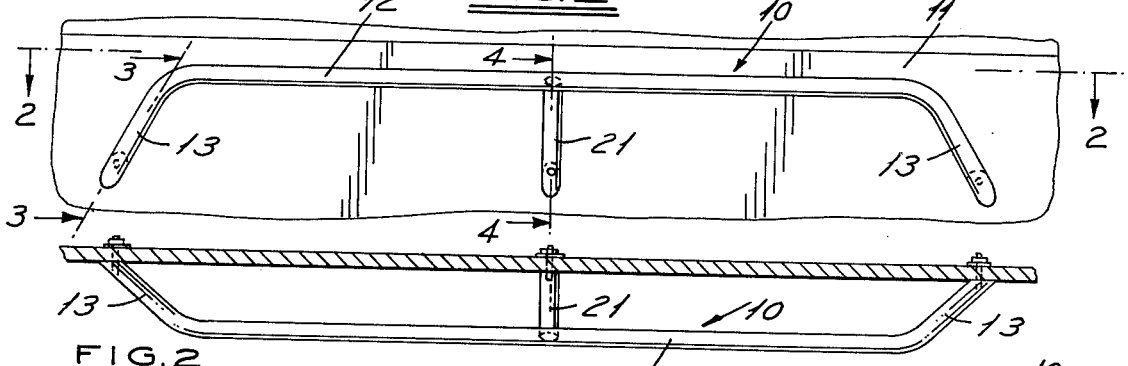
FIG. 1 is a fragmentary elevational view of a wall having a hand rail thereon embodying the invention.

Referring to FIG. 1, the hand rail 10 is adapted to be mounted on a wall 11 and is made of a single length of tubular material such as stainless steel of preferably substantially constant diameter. The rail 10 includes a central straight portion 12 that is adapted to extend horizontally in the embodiment shown and end portions 13 bent to form an obtuse angle with the central portion 12. The end 14 of each end portion 13 is cut at an angle so that the plane thereof forms an acute angle with the axis of the end portion 13 and the plane defined by the end portions 13 and central portion 12.

Figure 5:
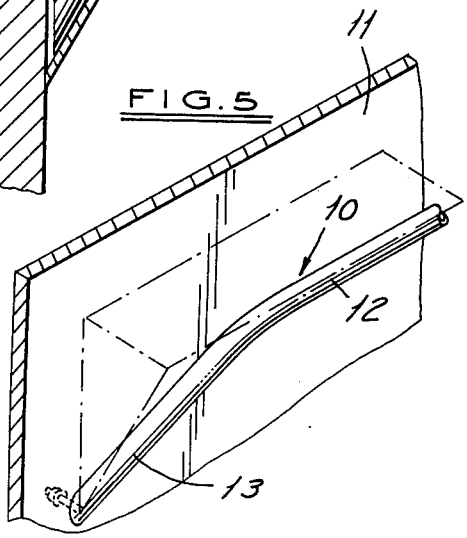
FIG. 5 is a fragmentary perspective view.

When the hand rail is placed against the wall 11, the plane of the ends 14 of the hand rail spaces the horizontal portion 12 away from the wall with the end portions 13 extending downwardly and outwardly from the wall as shown in FIG. 5. In this manner, a bar is provided that effectively supports the weight of a person grasping the same and yet does not have any protuberances. On the contrary, the inclined portions 13 avoid any tendency for clothing or the like to be engaged which might affect the stability of the person grasping the rail.

Means are provided for fastening the hand rail 10 to the wall through the end portions 13 preferably so that the fastening means is not exposed thereby further minimizing any obstructions which might become entangled with clothing and the like.

Figure 3:
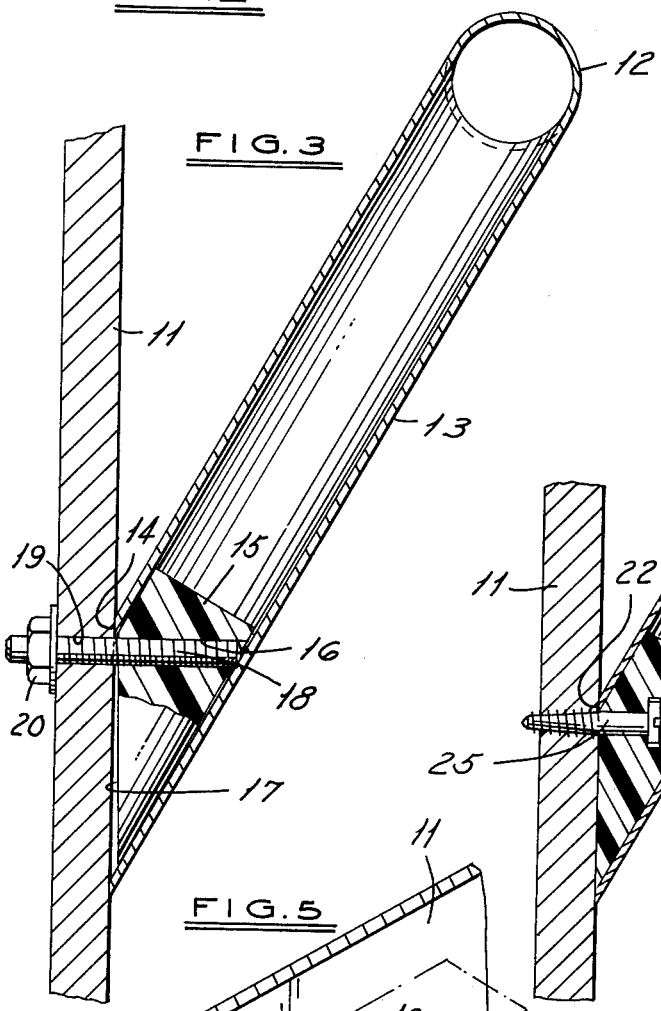
FIG. 3 is a fragmentary sectional view on an enlarged scale taken along the line 3—3 in FIG. 1.

As shown in FIG. 3, the means for fastening comprises an insert 15 of solid plastic such as polyurethane or nylon which has a threaded opening 16 and a cross section slightly less than the inner diameter of the tubular portion 13. The insert 15 further includes an inclined surface 17 corresponding with the plane of the end 14. In this form, a bolt or stud 18 is inserted through an opening 19 in the wall 11 and threaded into the insert and a nut 20 is then threaded on the stud. To facilitate handling of the rail before application to the wall, the stud 18 can be threaded inwardly to engage the inner surface of the tube, as shown in FIG. 3, thereby holding the insert in the end portion 13 until the rail is applied to the wall. By further tightening the nut 20 after it is placed on the stud, the stud will be pulled slightly away from the inner surface of the tubular portion 13 bringing the insert surface 17 against the surface of the wall.

Figure 2:
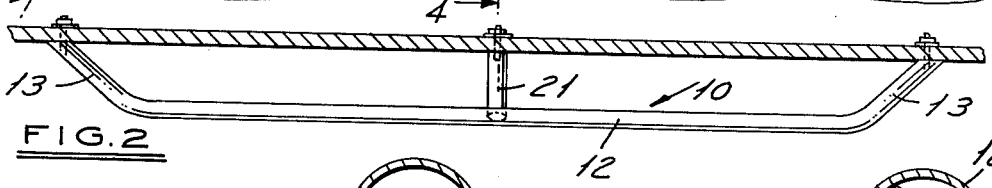
FIG. 2 is a fragmentary sectional view taken along the line 2—2 in FIG. 1.
Figure 4:
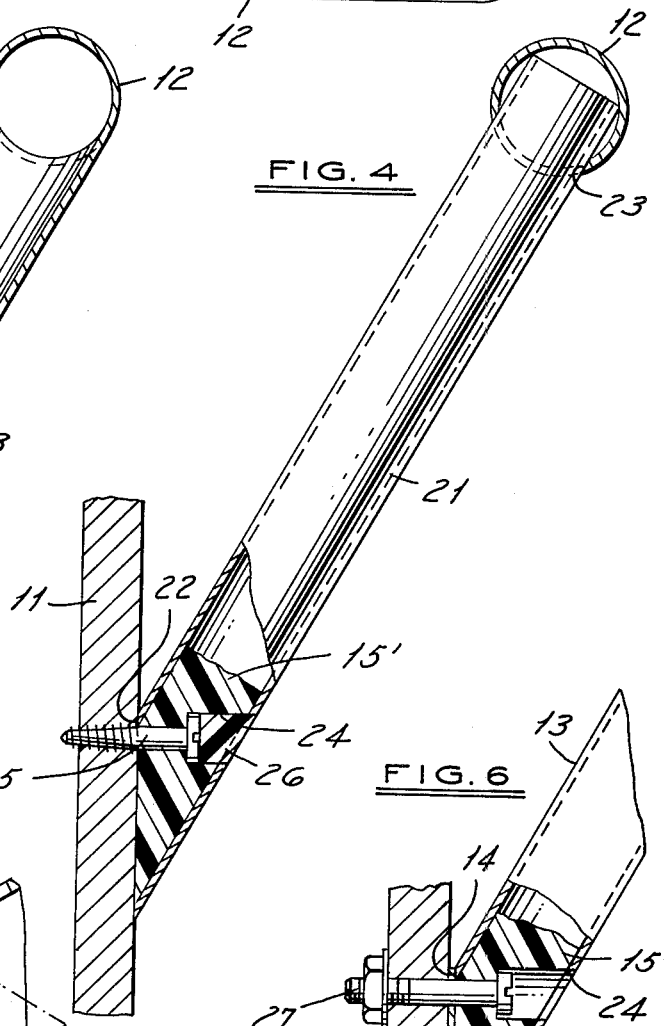
FIG. 4 is a fragmentary sectional view on an enlarged scale taken along the line 4—4 in FIG. 1.

It has been found that the engagement of the end 14 with the wall provides sufficient strength to bear the weight of any person using the hand rail.

Where the length of the hand rail is quite substantial, additional support may be provided at points intermediate the ends as shown in FIGS. 1, 2 and 4 by utilizing a separate tube 21 which has an end 22 cut at an angle which extends through an opening 23 in the central portion 12. The tube 21 can be fastened to the wall as in FIG. 3 or, alternately, an opening 24 can be provided in the tube 21 to permit insertion of a screw 25, as shown in FIG. 4. The opening can then be filled by a filler plug 26. As further shown in FIG. 4, the insert 15' is molded in situ in the end of the tube rather than being a separate piece as in FIG. 3.

Figure 6:
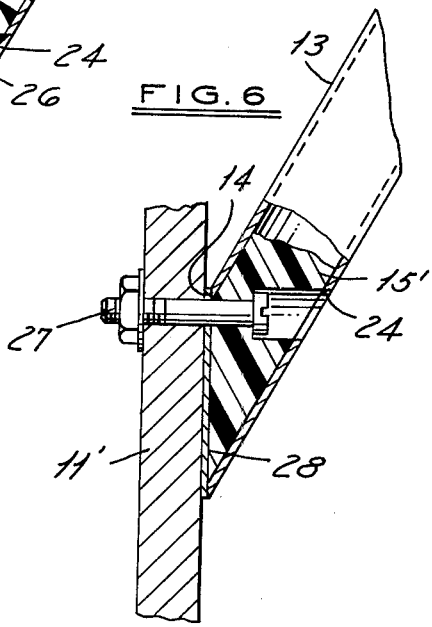
FIG. 6 is a fragmentary sectional view similar to FIG. 3 showing a modified form of the invention.

A modified form of fastening of the end portions 13 or tube 21 is shown in FIG. 6 wherein a bolt 27 is utilized in place of the screw 25. In this form, if the wall is made of lightweight particle material, a washer 28 of the general configuration as the end 14 of the tube 13 is interposed between the end of the tube and the wall 11' to prevent cutting of the edge into the wall.

Figure 7:
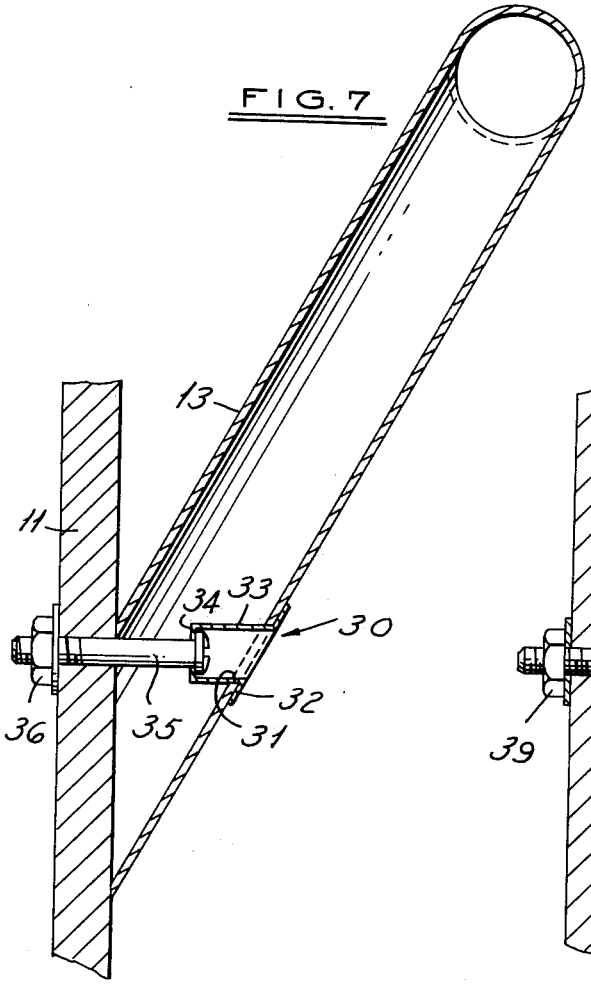
FIG. 7 is a fragmentary sectional view similar to FIG. 3 showing a further modified form of the invention.

In the modified form of fastening shown in FIG. 7, a metal insert 30 is provided through an opening 31 in the end portion 13. The insert includes a flange 32 conforming with the curvature of the exterior of the end portion and a recess or countersunk extension 33 defining a shoulder 34 for the head of a bolt 35 that is passed through an opening in the wall 11. A nut 36 is applied from the rear of the wall is tightened to hold the rail in position.

Figure 8:
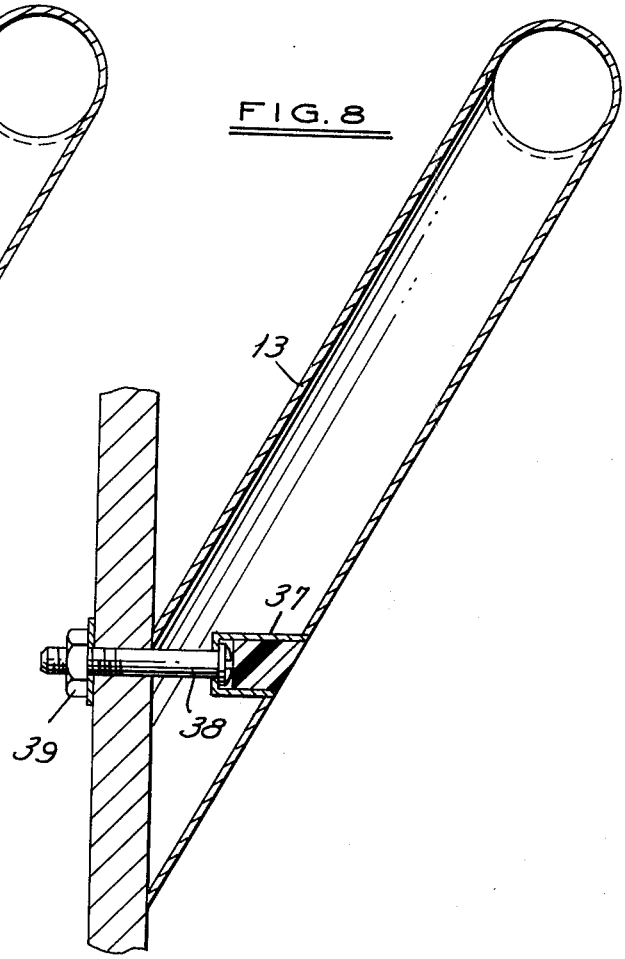
FIG. 8 is a fragmentary sectional view similar to FIG. 3 showing another form of the invention.

In the form of the invention shown in FIG. 8, the countersunk or recessed portion 37 is extruded from the tubular portion 13 and the bolt 38 and nut 39 are provided in the manner of FIG. 7.

Figure 9:
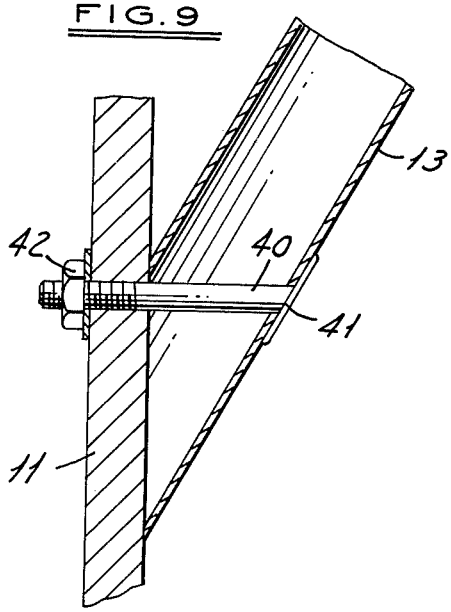
FIG. 9 is a fragmentary sectional view similar to FIG. 3 showing another modified form of the invention.

In the form of the fastening shown in FIG. 9, a headed bolt 40 is provided which has a head 41 in the form of a thin washer like plate conforming with the external configuration of the portion 13 and extends through the wall 11 with a nut 42 fastening the hand rail.

It can thus be seen that there has been provided a hand rail which will effectively hold the weight of a user and yet does not have obstructions and which can be manufactured at low cost since it does not involve the use of flanges or extra brackets.

In the form of the invention shown in FIGS. 10–14, the handrail 50 is similar to that previously described and comprises a central horizontal portion 51 and end portions 52 having their free ends cut at an acute angle and lying in a plane forming an angle with the axis of the end portions 52. An insert 53 is provided in each end portion and has an end surface 54 at an acute angle to the axis of the insert and at the same angle as the plane containing the end of the end portions 52. A projection 55 in the form of a headed screw engages a slot 56 that extends transversely of insert 53 with its axis spaced from a right angle to the axis of the insert 53.

Figures 10, 11, 12, 13, 14, 15, 16:
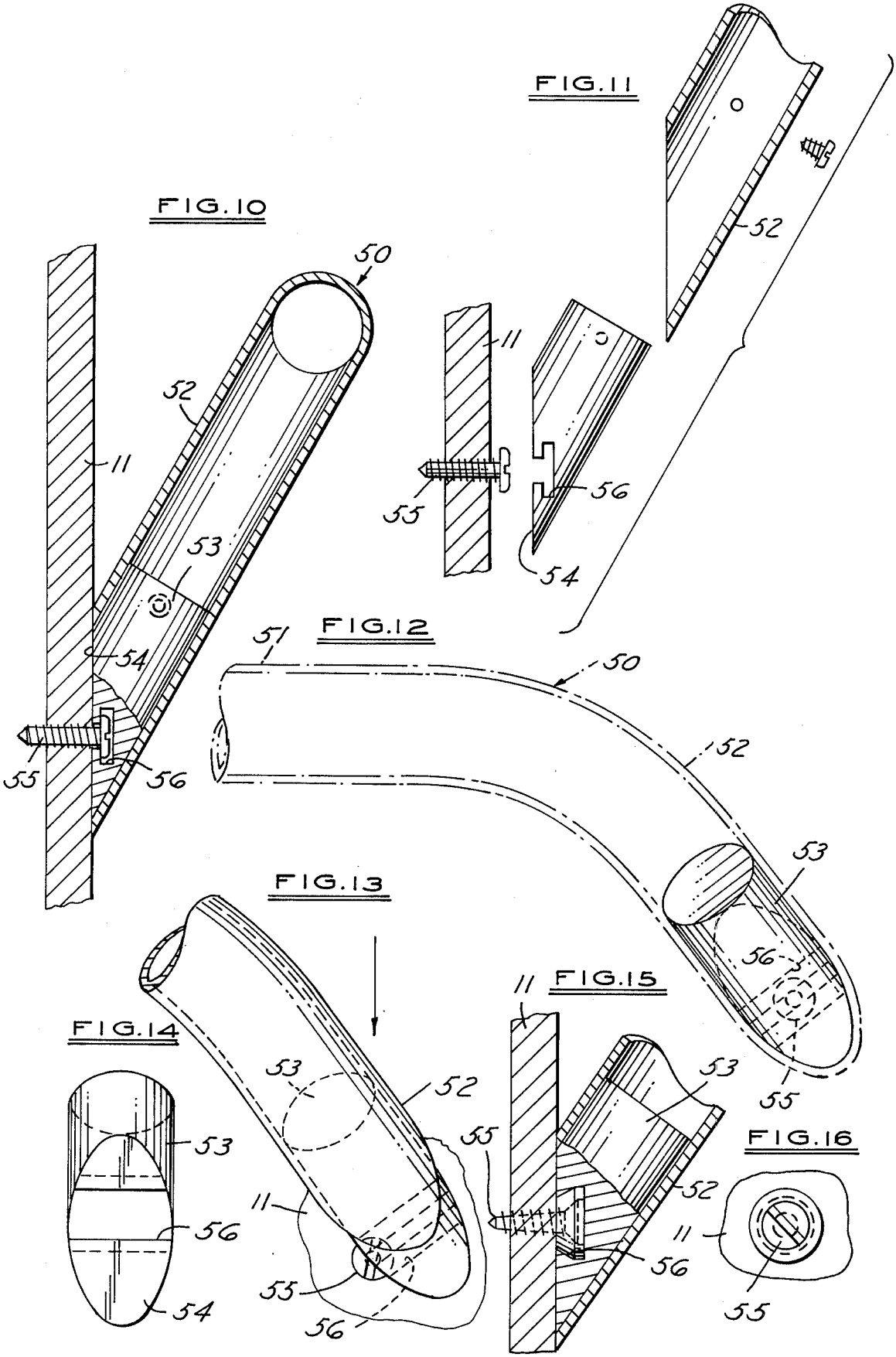
FIG. 10 is a vertical sectional view through a modified form of the invention.
FIG. 11 is a fragmentary exploded view of the same.
FIG. 12 is a front view, parts being broken away.
FIG. 13 is a view similar to FIG. 12 showing the handrail construction during assembly.
FIG. 14 is an end view of an insert utilized in the construction shown in FIGS. 10–13.
FIG. 15 is a fragmentary vertical sectional view of a further modified form of the invention.
FIG. 16 is a front view of a portion of the structure shown in FIG. 15.

Initially, the fasteners 55 are provided at the appropriate distances apart on the wall 11, the inserts 53 are partially inserted in the end portions 52 and partially engaged with the headed fasteners as shown in FIG. 13, and finally, a downward force at a right angle to the portion 51 is applied to the central portion 51 causing the inserts 53 to become fully engaged with the head fasteners and to pass axially inwardly into the end portions 52 until the end of the end portions 52 engage the wall. In this manner, the full weight applied to the handrail is taken by the wall and the mounting is achieved without the use of tools except as may be required, the screw and the fasteners 55.

Figure 17:
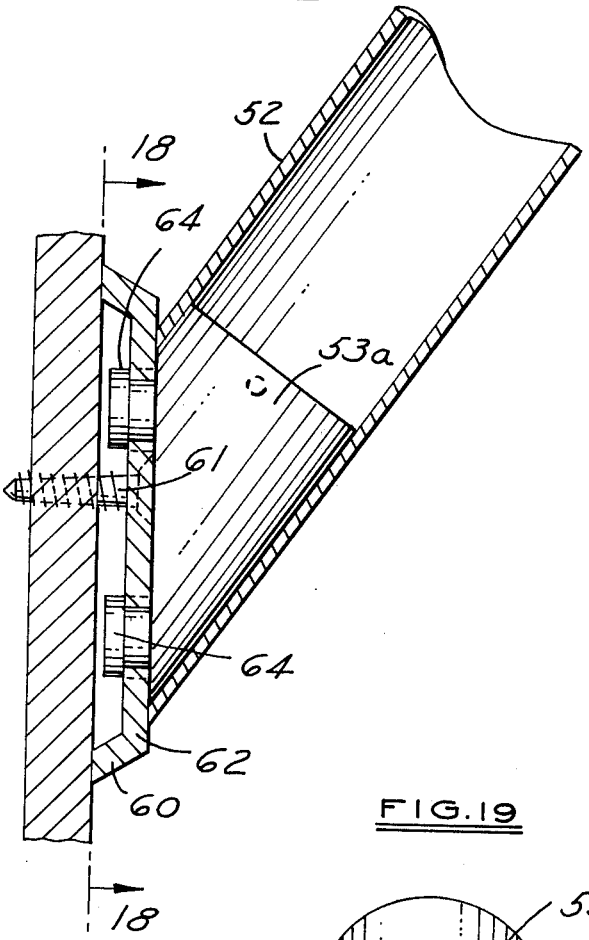
FIG. 17 is a vertical sectional view of a further modified form of the invention.
Figure 18:
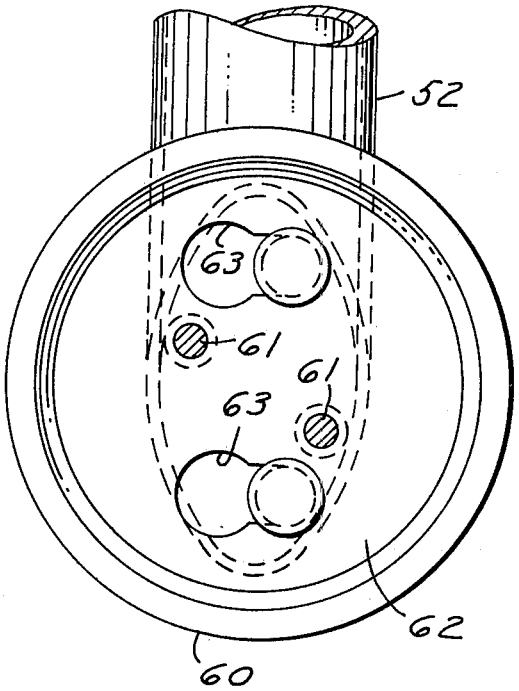
FIG. 18 is a view taken along the line 18—18 in FIG. 17.
Figure 19:
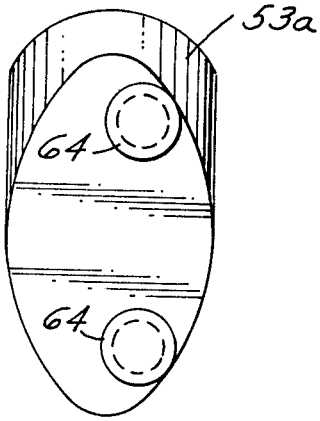
FIG. 19 is an end view of an insert utilized in the form of the invention shown in FIGS. 17 and 18.

In the form of the invention shown in FIGS. 15 and 16, the handrail and inserts are substantially the same as described in connection with FIGS. 10–14 except that the slot 56 is in the form of a dove tail and the head of the fastener 55 has a complementary configuration.

Where the wall is of a softer material that can not take the full force of a relatively narrow thickness of two, the structure such as shown in FIGS. 17–19 can be used wherein a plate 60 is applied to the wall by screws 61 and includes a spaced wall 62 having key slot openings 63 therein. The insert **53*a* is formed with headed projections 64 that are inserted in the enlarged portions of the key slot 63 and the rail then pushed downwardly, as in the previous forms of the invention shown in FIGS. 10–16, to engage the heads behind the narrow portions of the key slot 63**.

In order to provide centering of the inserts and the end portions 52 in the circular wall 62, the projections 64 have their axes lying in a plane spaced from the center of the insert **53*a***.

I claim:

1. In a hand rail, the combination comprising a wall, a hand rail comprising a length of tubular material including a central portion and end portions extending from said central portion at an obtuse angle, said end portions having free ends defining a plane which is at an acute angle to the plane of said central portion and end portions, said ends of said end portions engaging said wall, means for fastening said rail to said wall at said ends of said end portions comprising an insert in each end portion, a fastener extending therefrom through said wall, said insert being molded in situ, said fastener extending through an opening in said end portions into said wall.

2. In a hand rail, the combination comprising a wall, a hand rail comprising a length of tubular material including a central portion and end portions extending from said central portion at an obtuse angle, said end portions having free ends defining a plane which is at an acute angle to the plane of said central portion and end portions, said ends of said end portions engaging said wall, means for fastening said rail to said wall at said ends of said end portions comprising an insert in each end portion, a fastener extending therefrom through said wall, and a filler covering said fastener.

3. In a hand rail, the combination comprising a wall, a hand rail comprising a length of tubular material including a central portion and end portions extending from said central portion at an obtuse angle, said end portions having free ends defining a plane which is at an acute angle to the plane of said central portion and end portions, said ends of said end portions engaging said wall, means for fastening said rail to said wall at said ends of said end portions, and a washer interposed between each end portion and said wall and having the general configuration of the end of each end portion.

4. A hand rail for mounting on a wall and the like comprising a length of tubular material including a central portion and end portions extending from said central portion at an obtuse angle, said end portions having free ends defining a plane which is at an acute angle to the plane of said central portion and end portions, said ends of said end portions being adapted to engage said wall including an insert in each end portion, a fastener adapted to extend into said insert and through a wall, said insert being molded in situ.

5. A hand rail for mounting on a wall and the like comprising a length of tubular material including a central portion and end portions extending from said central portion at an obtuse angle, said end portions having free ends defining a plane which is at an acute angle to the plane of said central portion and end portions, said ends of said end portions being adapted to engage said wall including an insert in each end portion, a fastener adapted to extend into said insert and through a wall, and a filler adapted to cover said fastener.

6. A hand rail for mounting on a wall and the like comprising a length of tubular material including a central portion and end portions extending from said central portion at an obtuse angle, said end portions having free ends defining a plane which is at an acute angle to the plane of said central portion and end portions, said ends of said end portions being adapted to engage said wall, and a washer adapted to be interposed between each end portion and a wall and having the general configuration of the end of each end portion.

7. In a hand rail, the combination comprising a wall, a hand rail comprising a length of tubular material including a central portion and end portions extending from said central portion at obtuse angles, said end portions having free ends engaging said wall, each said free end lying in a plane that is at an acute angle to the axis of the respective end portion and to the plane defined by the respective end portion and central portion, means for fastening said rail to said wall at said ends of said end portions, said last-mentioned means comprising an insert in each end portion, and a fastener extending therefrom through said wall and engaging said end portion of said rail.

8. In a hand rail, the combination comprising a wall, a hand rail comprising a length of tubular material including a central portion and end portions extending from said central portion at obtuse angles, said end portions having free ends engaging said wall, each said free end lying in a plane that is at an acute angle to the axis of the respective end portion and to the plane defined by the respective end portion and central portion, means for fastening said rail to said wall at said ends of said end portions, said means for fastening said rail comprising an integral recess in each said end portion, a fastener extending through said recess to said wall.

9. The combination set forth in claim 8 including an insert positioned in said recess to cover said fastener.

10. In a hand rail, the combination comprising a wall, a hand rail comprising a length of tubular material including a central portion and end portions extending from said central portion at obtuse angles, said end portions having free ends engaging said wall, each said free end lying in a plane that is at an acute angle to the axis of the respective end portion and to the plane defined by the respective end portion and central portion, each said end portion having an opening therein and a surface about said opening, means for fastening said rail to said wall at said ends of said end portions, said fastening means comprising a bolt having a head inclined to conform to said surface of said opening in said end portions and extending through said wall.

11. A hand rail on a wall or the like comprising a length of tubular material including a central portion and end portions extending from said central portion at an obtuse angle, said end portions having free ends, each said free end lying in a plane that is at an acute angle to the axis of the respective end portion and to the plane defined by the respective end portion and central portion, said last-mentioned means comprising an insert in each end portion, and a fastener extending therefrom through said wall and engaging said end portion of said rail.

12. A hand rail on a wall or the like comprising a length of tubular material including a central portion and end portions extending from said central portion at an obtuse angle, said end portion having free ends, each said free end lying in a plane that is at an acute angle to the axis of the respective end portion and to the plane defined by the respective end portion and central portion, said means for fastening said tube comprising an integral recess in each said end portion, a fastener extending through said recess to said wall.

13. The combination set forth in claim 12 including an insert positioned in said recess to cover said fastener.

14. A hand rail on a wall or the like comprising a length of tubular material including a central portion and end portions extending from said central portion at an obtuse angle, said end portions having free ends, each said free end lying in a plane that is at an acute angle to the axis of the respective end portion and to the plane defined by the respective end portion and central portion, each said end portion having an opening therein and a surface about said opening, said fastening means comprising a bolt having a head inclined to conform to said surface of said opening in said end portions and extending through said wall.

15. A hand rail comprising a wall, a hand rail comprising a length of tubular material including a central portion and end portions extending from the central portion at an obtuse angle, said end portions having free ends defining a plane which is at an acute angle to the plane defined by the axis of said central portion and the axis of said end portions, an insert in each end portion, each said insert having substantially the same cross section as its respective end portion and having an end which lies in a plane parallel to the plane of the end of its respective end portion, at least one projection extending from one of said wall and each said insert, the other of said wall and said end portions having a transverse slot therein through which said fastener extends.

16. The combination set forth in claim 15 wherein said fastener and slot comprise a dove tail construction.

17. The combination set forth in claim 16 wherein the axis of said slot extends transversely to the axis of its respective end portion and in spaced therefrom, such that the inserts can be partially inserted in the end portions of the rail, the fastener and slots partially engaged and then the inserts be fully seated in the end portions by applying a force transverse to the central portion.

18. The combination set forth in claim 15 wherein said fastener is in said wall and said slot is in said insert.

19. The combination set forth in claim 18 wherein said fastener comprises a headed screw.

20. The combination set forth in claim 19 wherein the head of said screw is in the form of a dove tail and said slot has a corresponding cross section.

21. The combination set forth in claim 15 wherein said slot extends entirely across said insert.

22. The combination set forth in claim 15 wherein said means for fastening said hand rail comprises enlarged projections on said insert, a fastener plate mounted on said wall, said plate having key-shaped slots therein which are engaged by said projections.

23. The combination set forth in claim 22 wherein the axis of said key-shaped slots is at a right angle to the axis of the end portions and in spaced from the axis.

24. A hand rail for a wall or the like comprising a hand rail comprising a length of tubular material including a central portion and end portions extending from the central portion at an obtuse angle, said end portions having free ends defining a plane which is at an acute angle to the plane defined by the axis of said central portion and the axis of said end portions, an insert in each end portion, said insert having substantially the same cross section as its respective said end portion and having an end which lies in a plane parallel to the plane of the end of its respective end portion, at least one projection extending from one of said wall and each said insert, the other of said wall and said end portions having a transverse slot therein through which said projection extends.

25. The combination set forth in claim 24 wherein said slot is in said insert.

26. The combination set forth in claim 25 wherein the axis of said slot extends transversely to the axis of its respective end portion and is spaced therefrom, such that the inserts can be partially inserted in the end portions of the rail, the projections attached to a wall, the slots partially engaged and then the inserts be fully seated in the end portions by applying a force transverse to the central portion.

27. The combination set forth in claim 26 wherein said projection comprises a headed screw.

28. The combination set forth in claim 27 wherein the head of said screw is in the form of a dove tail and said slot has a corresponding cross section.

29. The combination set forth in claim 27 wherein said slot extends entirely across said insert.

30. The combination set forth in claim 24 including, a fastener plate adapted to be mounted on a wall, said plate having a key-shaped slot therein which is engaged by said projection.

31. The combination set forth in claim 24 wherein the axis of said key-shaped slot is at a right angle to the axis of the end portions and is spaced from the axis.

32. The combination set forth in claim 31 wherein said projections have their centers in a plane lying in spaced relationship to the axis of said insert.

* * * * *